US005978763A

United States Patent [19]

Bridges

[11] Patent Number: 5,978,763

[45] Date of Patent: Nov. 2, 1999

[54] VOICE ACTIVITY DETECTION USING ECHO RETURN LOSS TO ADAPT THE DETECTION THRESHOLD

[75] Inventor: James A Bridges, Rugby, United Kingdom

[73] Assignee: British Telecommunications public limited company, London, United Kingdom

[21] Appl. No.: 08/894,080

[22] PCT Filed: Feb. 15, 1996

[86] PCT No.: PCT/GB96/00344

§ 371 Date: Aug. 13, 1997

§ 102(e) Date: Aug. 13, 1997

[87] PCT Pub. No.: WO96/25733

PCT Pub. Date: Aug. 22, 1996

[30] Foreign Application Priority Data

Feb. 15, 1995 [EP] European Pat. Off. ..... 95300975

[51] Int. Cl.[6] ..... G10L 9/18

[52] U.S. Cl. ..... 704/233; 704/226; 379/406

[58] Field of Search ..... 704/233, 214, 704/215, 226, 227, 228; 379/406, 410, 88.01, 72

[56] References Cited

U.S. PATENT DOCUMENTS

| | | | |
|---|---|---|---|
| 4,192,979 | 3/1980 | Jankowski | 379/406 |
| 4,410,763 | 10/1983 | Strawczynski et al. | 704/214 |
| 4,897,832 | 1/1990 | Suzuki et al. | 370/287 |
| 4,914,692 | 4/1990 | Hartwell et al. | 379/410 |
| 5,125,024 | 6/1992 | Gokcen et al. | 379/88.01 |
| 5,155,760 | 10/1992 | Johnson et al. | 379/88.01 |
| 5,434,916 | 7/1995 | Hasegawa | 379/406 |
| 5,475,791 | 12/1995 | Schalk et al. | 704/233 |
| 5,577,097 | 11/1996 | Meek | 379/3 |
| 5,619,566 | 4/1997 | Fogel | 379/406 |
| 5,765,130 | 6/1998 | Nguyen | 704/233 |

FOREIGN PATENT DOCUMENTS

| | | | |
|---|---|---|---|
| 0 604 870 | 7/1994 | European Pat. Off. | H04B 3/23 |
| 0 625 774 | 11/1994 | European Pat. Off. | G10L 3/00 |
| 2109209 | 5/1983 | United Kingdom | H04B 3/23 |
| 2 268 669 | 1/1994 | United Kingdom | G10L 9/14 |

OTHER PUBLICATIONS

Harry Newton, "Newton's Telecom Dictionary," Flatiron Publishing, Nov. 1994, pp. 462 and 519, Nov. 1994.

Thomas W. Parsons, "Voice and Speech Processing," McGraw–Hill, Inc., New York, 1987, pp. 125–127, 293–297, 1987.

Patent Abstracts of Japan, vol. 013, No. 468 (E–834), Oct. 23, 1989 & JP, A,01 183232 (OKI Electric Ind Co Ltd), Jul. 21, 1989, see abstract.

IEEE Transactions on Communications, vol. COM–20, No. 1, Feb. 1972, US, XP000565246 Fariello: "A novel digital speech detector for improving effective satellite capacity" see paragaraph 1.

*Primary Examiner*—David R. Hudspeth
*Assistant Examiner*—Donald L. Storm
*Attorney, Agent, or Firm*—Nixon & Vanderhye P.C.

[57] ABSTRACT

A voice activity detector has an input for receiving an outgoing speech signal transmitted from a speech system to a user and an input for receiving an incoming signal from the user. Both the outgoing and incoming signals are divided into time limited frames. A feature is calculated from each frame of the incoming signal and for forming a function of the calculated feature and a threshold. Based on the function, it is determined whether or not the incoming signal includes speech. Means are provided to determine the echo return loss during an outgoing speech signal from the interactive speech system and to control the threshold in dependence on the echo return loss measured.

24 Claims, 2 Drawing Sheets

VOICE ACTIVITY DETECTION USING ECHO RETURN LOSS TO ADAPT THE DETECTION THRESHOLD

BACKGROUND OF THE INVENTION

1. Field of the Invention

This invention relates to voice activity detection.

2. Related Art

There are many automated systems that depend on the detection of speech for operation, for instance automated speech systems and cellular radio coding systems. Such systems monitor transmission paths from users' equipment for the occurrence of speech and, on the occurrence of speech, take appropriate action. Unfortunately transmission paths are rarely free from noise. Systems which are arranged simply to detect activity on the path may therefore incorrectly take action if there is noise present.

The usual noise that is present is line noise (i.e. noise that is present irrespective of whether or not a signal is being transmitted) and background noise from a telephone conversation, such as a dog barking, the sound of the television, the noise of a car's engine etc.

Another source of noise in communications systems is echo. For instance, echoes in a public switch telephone network (PSTN) are essentially caused by electrical and/or acoustic coupling e.g. at the four wire to two wire interface of a conventional exchange box; or the acoustic coupling in a telephone handset, from earpiece to microphone. The acoustic echo is time variant during a call due to the variation of the airpath, i.e. the talker altering the position of their head between the microphone and the loudspeaker. Similarly in telephone kiosks, the interior of the kiosk has a limited damping characteristic and is reverberant which results in resonant behaviour. Again this causes the acoustic echo path to vary if the talker moves around the kiosk or indeed with any air movement. Acoustic echo is becoming a more important issue at this time due to the increased use of hands free telephones. The effect of the overall echo or reflection path is to attenuate, delay and filter a signal.

The echo path is dependent on the line, switching route and phone type. This means that the transfer function of the reflection path can vary between calls since any of the line, switching route and the handset may change from call to call as different switch gear will be selected to make the connection.

Various techniques are known to improve the echo control in human-to-human speech communications systems. There are three main techniques. Firstly insertion losses may be added into the talker's transmission path to reduce the level of the outgoing signal. However the insertion losses may cause the received signal to become intolerably low for the listener. Alternatively, echo suppressors operate on the principle of detecting signal levels in the transmitting and receiving path and then comparing the levels to determine how to operate switchable insertion loss pads. A high attenuation is placed in the transmit path when speech is detected on the received path. Echo suppressors are usually used on longer delay connections such as international telephony links where suitable fixed insertion losses would be insufficient.

Echo cancellers are voice operated devices which use adaptive signal processing to reduce or eliminate echoes by estimating an echo path transfer function. An outgoing signal is fed into the device and the resulting output signal subtracted from the received signal. Provided that the model is representative of the real echo path, the echo should theoretically be cancelled. However, echo cancellers suffer from stability problems and are computationally expensive. Echo cancellers are also very sensitive to noise bursts during training.

One example of an automated speech system is the telephone answering machine, which records messages left by a caller. Generally, when a user calls up an automated speech system, a prompt is played to the user which prompt usually requires a reply. Thus an outgoing signal from the speech system is passed along a transmission line to the loudspeaker of a user's telephone. The user then provides a response to the prompt which is passed to the speech system which then takes appropriate action.

It has been proposed that allowing a caller to an automated speech system to interrupt outgoing prompts from the system greatly enhances the usability of the system for those callers who are familiar with the dialogue of the system. This facility is often termed "barge in" or "over-ridable guidance".

If a user speaks during a prompt, the spoken words may be preceded or corrupted by an echo of the outgoing prompt. Essentially isolated clean vocabulary utterances from the user are transformed into embedded vocabulary utterances (in which the vocabulary word is contaminated with additional sounds). In automated speech systems which involve automated speech recognition, because of the limitations of current speech recognition technology, this results in a reduction in recognition performance.

If a user has never used the service provided by the automated speech system, the user will need to hear the prompts provided by the speech generator in their entirety. However, once a user has become familiar with the service and the information that is required at each stage, the user may wish to provide the required response before the prompt has finished. If a speech recogniser or recording means is turned off until the prompt is finished, no attempt will be made to recognise a user's early response. If, on the other hand, the speech recogniser or recording means is turned on all the time, the input would include both the echo of the outgoing prompt and the response provided by the user. Such a signal would be unlikely to be recognisable by a speech recogniser. Voice activity detectors (VADs) have therefore been developed to detect voice activity on the path.

Known voice activity detectors rely on generating an estimate of the noise in an incoming signal and comparing an incoming signal with the estimate which is either fixed or updated during periods of non-speech. An example of such a voice activated system is described in U.S. Pat. No. 5,155,760 and U.S. Pat. No. 4,410,763.

Voice activity detectors are used to detect speech in the incoming signal, and to interrupt the outgoing prompt and turn on the recogniser when such speech is detected. A user will hear a clipped prompt. This is satisfactory if the user has barged in. If however the voice activity detector has incorrectly detected speech, the user will hear a clipped prompt and have no instructions on to how to proceed with the system. This is clearly undesirable.

SUMMARY OF THE INVENTION

The present invention provides a voice activity detector for use with a speech system, the voice activity detector comprising an input for receiving an outgoing speech signal transmitted from a speech system to a user and an input for receiving an incoming signal from the user, both the outgoing and incoming signals being divided into time limited frames, means for calculating a feature from each frame of the incoming signal, means for forming a function of the calculated feature and a threshold and, based on the function, determining whether or not the incoming signal includes speech, characterised in that means are provided to determine the echo return loss during an outgoing speech signal from the interactive speech system and to control the threshold in dependence on the echo return loss measured.

The echo return loss is derived from the difference in the level of the outgoing signal and the level of the echo of the outgoing signal received by the voice activity detector. The echo return loss is a measure of attenuation of the outgoing prompt by the transmission path.

Controlling the threshold on the basis of the echo return loss measured not only reduces the number of false triggerings by the voice activity detector due to echo, but also reduces the number of triggerings of the voice activity detector when the user makes a response over a line having a high amount of echo. Whilst this may appear unattractive, it should be appreciated that it is preferable for the voice activity detector not to trigger when the user barges in than for the voice activity detector to trigger when the user has not barged in, which would leave the user with a clipped prompt and no further assistance.

The threshold may be a function of the echo return loss and the maximum possible power of the outgoing signal. Both of these are long-term characteristics of the line (although the echo return loss may be remeasured from time to time). Preferably the threshold is the difference between the maximum power and the echo return loss. It may be preferred that the threshold is a function of the echo return loss and the feature calculated from each frame of the outgoing speech signal (i.e. the threshold represents an attenuation of each frame of the outgoing signal).

Preferably the feature calculated is the average power of each frame of a signal although other features, such as the frame energy, may be used. More than one feature of the incoming signal may be calculated and various functions formed.

The voice activity detector may further include data relating to statistical models representing the calculated feature for at least a signal containing substantially noise-free speech and a noisy signal, the function of the calculated feature and the threshold being compared with the statistical models. The noisy signal statistical models may represent line noise and/or typical background noise and/or an echo of the outgoing signal.

In accordance with the invention there is also provided a method of voice activity detection comprising receiving an outgoing speech signal transmitted from a speech system to a user and receiving an incoming signal from the user, both the outgoing and incoming signals being divided into time limited frames, calculating a feature from each frame of the incoming signal, forming a function of the calculated feature and a threshold and, based on the function, determining whether or not the incoming signal includes speech, characterised by measuring the echo return loss during an outgoing speech signal from the speech system and controlling the threshold in dependence on the echo return loss measured.

Preferably the threshold is a function of the echo return loss and the maximum possible power of the outgoing signal. As mentioned above, the threshold may be a function of the echo return loss and the same feature calculated from a frame of the outgoing speech signal. The feature calculated may be the average power of each frame of a signal.

BRIEF DESCRIPTION OF THE DRAWINGS

The invention will now be further described by way of example with reference to the accompanying drawings in which.

DETAILED DESCRIPTION OF EXEMPLARY EMBODIMENTS

Figure 1:
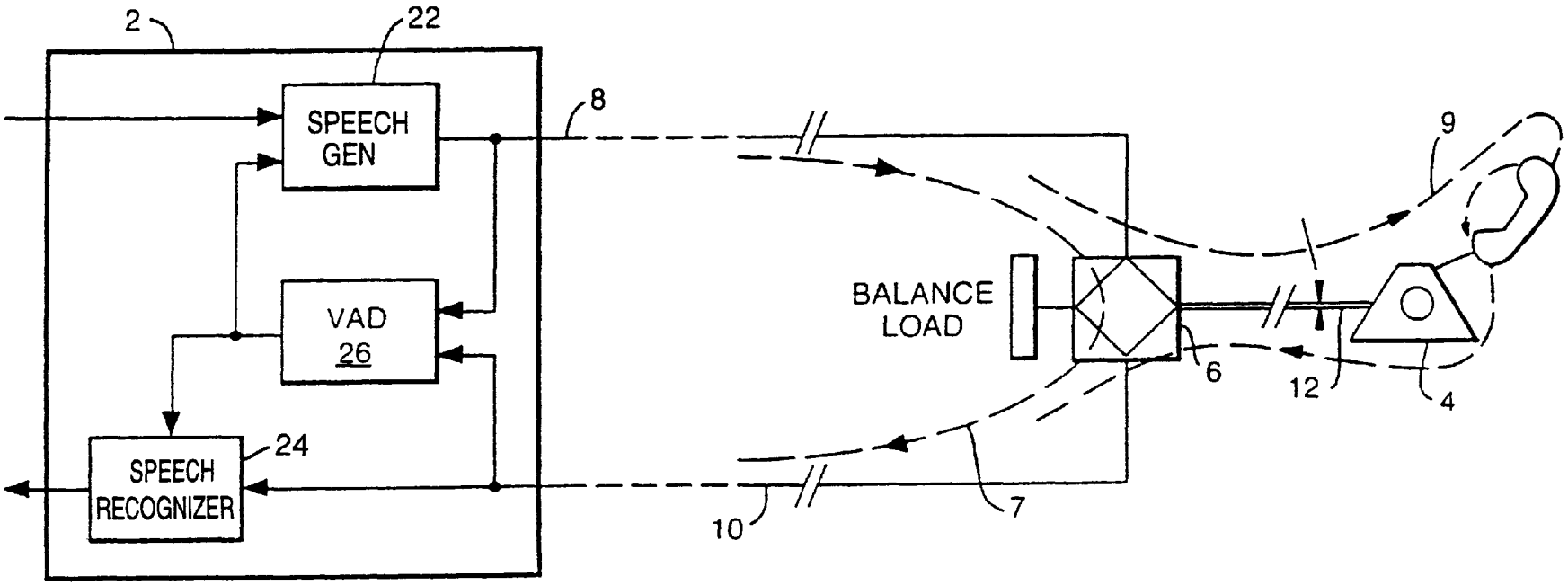
FIG. 1 shows an automated speech system including a voice activity detector according to the invention.

FIG. 1 shows an automated speech system 2, including a voice activity detector according to the invention, connected via the public switched telephone network to a user terminal, which is usually a telephone 4. The automated speech system is preferably located at an exchange in the network. The automated speech system 2 is connected to a hybrid transformer 6 via an outgoing line 8 and an incoming line 10. A user's telephone is connected to the hybrid via a two-way line 12.

Echoes in the PSTN are essentially caused by electrical and/or acoustic coupling e.g., the four wire to two wire interface at the hybrid transformer 6 (indicated by the arrow 7). Acoustic coupling in the handset of the telephone 4, from earpiece to microphone, causes acoustic echo (indicated by the arrow 9).

The automated speech system 2 comprises a speech generator 22, a speech recogniser 24 and a voice activity detector (VAD) 26. The type of speech generator 22 and speech recogniser 24 will not be discussed further since these do not form part of the invention. It will be clear to a person skilled in the art that any suitable speech generator, for instance those using text to speech technology or pre-recorded messages, may be used. In addition any suitable type of speech recogniser 24 may be used.

In use, when a user calls up the automated speech system the speech generator 22 plays a prompt to the user, which usually requires a reply. Thus an outgoing speech signal from the speech system is passed along the transmission line 8 to the hybrid transformer 6 which switches the signal to the loudspeaker of the user's telephone 4. At the end of a prompt, the user provides a response which is passed to the speech recogniser 24 via the hybrid 6 and the incoming line 10. The speech recogniser 24 then attempts to recognise the response and appropriate action is taken in response to the recognition result.

If a user has never used the service provided by the automated speech system, the user will need to hear the prompts provided by the speech generator 22 in their entirety. However, once a user has become familiar with the service and the information that is required at each stage, the user may wish to provide the required response before the prompt has finished. If the speech recogniser 24 is turned off until the prompt is finished, no attempt will be made to recognise the user's early response. If, on the other hand, the speech recogniser 24 is turned on all the time, the input to the speech recogniser would include both the echo of the outgoing prompt and the response provided by the user. Such a signal would be unlikely to be recognisable by the speech recogniser.

The voice activity detector 26 is provided to detect direct speech (i.e. speech from the user) in the incoming signal. The speech recogniser 24 is held in an inoperative mode until speech is detected by the voice activity detector 26. An output signal from the voice activity detector 26 passes to the speech generator 22, which is then interrupted (so clipping the prompt), and the speech recogniser 24, which, in response, becomes active.

Figure 2:
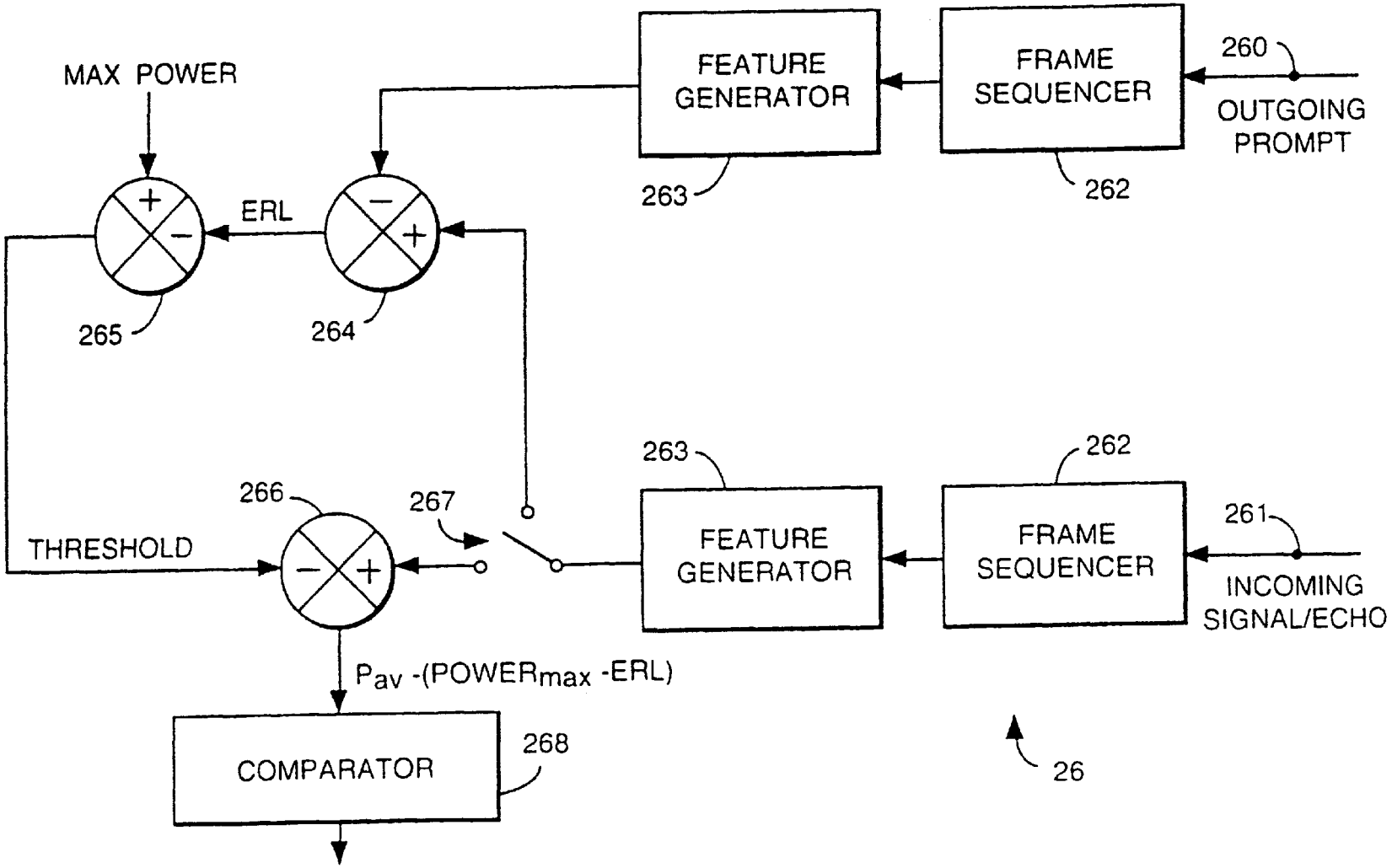
FIG. 2 shows the components of a voice activity detector according to the invention.

FIG. 2 shows the voice activity detector 26 of the invention in more detail. The voice activity detector 26 has an input 260 for receiving an outgoing prompt signal from the speech generator 22 and an input 261 for receiving the signal received via the incoming line 10. For each signal, the voice activity detector includes a frame sequencer 262 which divides the incoming signal into frames of data comprising 256 contiguous samples. Since the energy of speech is relatively stationary over 15 milliseconds, frames of 32 ms are preferred with an overlap of 16 ms between adjacent frames. This has the effect of making the VAD more robust to impulsive noise.

The frame of data is then passed to a feature generator 263 which calculates the average power of each frame. The average power of a frame of a signal is determined by the following equation:

$$\text{Log Average Frame Power } p_{av} = 10 \log_{10} \frac{\sum_{n=1}^{N} f_n(t)^2}{N}$$

where N is the number of samples in a frame, in this case 256.

Echo return loss is a measure of the attenuation i.e. the difference (in decibels) between the outgoing and the reflected signal. The echo return loss (ERL) is the difference between features calculated for the outgoing prompt and the returning echo i.e.

$$\text{ERL} = 10 \log_{10}\left[\frac{1}{N}\sum_{i=1}^{N} P_i(t)\rho|_{\text{incoming echo}}\right] - 10 \log_{10}\left[\frac{1}{N}\sum_{i=1}^{N} P_i(t)|_{\text{outgoing prompt}}\right]$$

where N is the number of samples over which the average power $P_i$ is calculated. N should be as high as is practicable.

As can be seen from FIG. 2, the echo return loss is determined by subtracting the average power of a frame of the outgoing prompt from the average power of a frame of the incoming echo. This is achieved by exciting the transmission path 8, 10 with a prompt from the system, such as a welcome prompt. The signal level of the outgoing prompt and the returning echo are then calculated as described above by frame sequencer 262 and feature generator 263. The resulting signal levels are subtracted by subtractor 264 to form the echo return loss.

The echo return loss is then subtracted by subtractor 265 from the maximum power possible for the transmission path i.e. the subtractor 265 calculates the threshold signal:

Threshold=Maximum possible power−echo return loss

Typical echo return loss is approximately 12 dB although the range is of the order of 6–30 dB the maximum possible power on a telephone line for an A-law signal is around 72 dB.

The ERL is calculated from the first 50 or so frames of the outgoing prompt, although more or fewer frames may be used.

Once the ERL has been calculated, the switch 267 is switched to pass the data relating to the incoming lime to the subtractor 266. The threshold signal is then, during the remainder of the call, subtracted by subtractor 266 from the average power of each frame of the incoming signal. Thus the output of the subtractor 266 is $P_{av}|$incoming signal−(Max possible power−ERL)

The output of subtractor 266 is passed to a comparator 268, which compares the result with a threshold. If the result is above the threshold, the incoming signal is deemed to include direct speech from the user and a signal is output from the voice activity detector to deactivate the speech generator 22 and activate the speech recogniser 24. If the result is lower than the threshold, no signal is output from the voice activity detector and the speech recogniser remains inoperative.

In another embodiment of the invention, the output of subtractor 266 is passed to a classifier (not shown) which classifies the incoming signal as speech or non-speech. This may be achieved by comparing the output of subtractor 266 with statistical models representing the same feature for typical speech and non-speech signals.

In a further embodiment, the threshold signal is formed according to the following equation:

$(P_{av}|_{outgoing\ prompt}-\text{ERL})$

The resulting threshold signal is input to subtractor 266 to form the product:

$P_{av}|_{incoming\ signal}-(P_{av}|_{outgoing\ prompt}-\text{ERL})$

The echo return loss is calculated at the beginning of at least the first prompt from the speech system. The echo return loss can be calculated from a single frame if necessary, since the echo return loss is calculated on a frame-by-frame basis. Thus, even if a user speaks almost immediately it is still possible for the echo return loss to be calculated.

The frame sequencers 262 and feature generators 263 have been described as being an integral part of the voice activity detector. It will be clear to a skilled person that this is not an essential feature of the invention, either or both of these being separate components. Equally it is not necessary for a separate frame sequencer and feature generator to be provided for each signal. A single frame sequencer and feature generator may be sufficient to generate a feature from each signal.

What is claimed is:

1. A voice activity detector for use with a speech system, the voice activity detector comprising:

an input for receiving an outgoing speech signal transmitted from the speech system to a users;

an input for receiving an incoming signal from the user, both the outgoing and incoming signals comprising time limited frames, means for calculating a feature from each frame of the incoming signal, means for forming a function of the calculated feature and a threshold and, based on the function, determining whether or not the incoming signal includes speech; and means for determining the echo return loss during an outgoing speech signal from the speech system and to control the threshold in dependence on the determined echo return loss.

2. A voice activity detector as in claim 1 wherein the threshold is a function of the determined echo return loss and the maximum possible power of the outgoing signal.

3. A voice activity detector as in claim 1 further comprising:

means for calculating a feature from a frame of the outgoing speech signal and means for establishing the threshold as a function of the determined echo return loss and a feature calculated from a frame of the outgoing speech signal.

4. A voice activity detector as in claim 1 wherein the feature calculated for a frame of the incoming and outgoing signals includes the average power of each frame.

5. A voice activity detector as in claim 1 in combination with a speech generator for generating an outgoing speech signal; and means arranged to control the operation of said speech generator responsive to the detection of speech in the incoming signal.

6. A voice activity detector and speech generator as in claim 5 further comprising means for determining the threshold as a function of the echo return loss and the maximum possible power of the outgoing signal.

7. A voice activity detector and speech generator as in claim 5 further comprising means for determining the threshold as a function of the echo return loss and a feature calculated from a frame of the outgoing speech signal.

8. A voice activity detector and speech generator as in claim 5 wherein the feature calculated is the average power of each frame of a signal.

9. A method of voice activity detection comprising:

receiving an outgoing signal transmitted from a speech system to a user;

receiving an incoming signal from the user, both the outgoing and incoming signals comprising time limited frames, calculating a feature from each frame of the incoming signal, forming a function of the calculated feature and a threshold, based on the function, determining whether or not the incoming signal includes speech;

measuring the echo return loss during an outgoing speech signal from the speech system; and controlling the threshold in dependence on the determined echo return loss.

10. A method as in claim 9 wherein the threshold is a function of the determined echo return loss and the maximum possible power of the outgoing signal.

11. A method as in claim 9 wherein the threshold is a function of the determined echo return loss and the same feature calculated from a frame of the outgoing speech signal.

12. A method as in claim 9 wherein the feature calculated is the average power of each frame of a signal.

13. A method of voice activity detection as in claim 9 further comprising:

transmitting an outgoing speech prompt signal to a user;

receiving an incoming echo signal;

both said outgoing speech signal and said incoming echo signal comprising time-divided frames;

deriving, during a beginning of said outgoing speech signal, the echo return loss based on the difference in the level of the outgoing speech signal and the level of the echo thereof, determining a threshold in dependence on the echo return loss;

determining a feature from each frame of the incoming signal;

evaluating a function of the calculated feature and said threshold;

detecting a user's spoken response based on said evaluation; and controlling the operation of said interactive speech apparatus responsive to the detection of the user's spoken response.

14. A method as in claim 13 wherein the threshold is a function of the echo return loss and the maximum possible power of the outgoing signal.

15. A method as in claim 13 wherein the threshold is a function of the echo return loss and the same feature calculated from a frame of the outgoing speech signal.

16. A method as in claim 13 wherein the feature calculated is the average power of each frame of a signal.

17. An interactive speech apparatus comprising:

a speech generator for generating an outgoing speech signal; and a voice activity detector comprising:

an input for receiving said outgoing speech signal;

an input for receiving an incoming echo signal, both the outgoing and incoming echo signals comprising time limited frames;

means for deriving during the beginning of said outgoing speech signal, the echo return loss from the difference in the level of said outgoing speech signal and the level of the echo thereof;

means for providing a threshold in dependence on the echo return loss;

means for providing a feature from each frame of the incoming signal;

means for evaluating a function of the provided feature and threshold;

means for determining, based on the evaluated function, whether or not the incoming signal includes direct speech from a user; and means arranged to control the operation of said speech apparatus responsive to the detection of direct speech from the user.

18. An interactive speech apparatus as in claim 17 further comprising means for determining the threshold as a function of the echo return loss and the maximum possible power of the outgoing signal.

19. An interactive speech apparatus as in claim 17 further comprising means for determining the threshold as a function of the echo return loss and a feature determined from a frame of the outgoing speech signal.

20. An interactive speech apparatus as in claim 17 wherein the feature determined is the average power of each frame of a signal.

21. A method of operating an interactive speech apparatus, said method comprising: transmitting an outgoing speech prompt signal to a user;

receiving an incoming echo signal;

both said outgoing speech signal and said incoming echo signal comprising time-divided frames;

deriving, during a beginning of said outgoing speech signal, the echo return loss based on the difference in the level of the outgoing speech signal and the level of the echo thereof;

determining a threshold in dependence on the echo return loss;

determining a feature from each frame of the incoming signal;

evaluating a function of the calculated feature and said threshold;

detecting a user's spoken response based on said evaluation; and controlling the operation of said interactive speech apparatus responsive to the detection of the user's spoken response.

22. A method as in claim 21 wherein the threshold is a function of the echo return loss and the maximum possible power of the outgoing signal.

23. A method as in claim 21 wherein the threshold is a function of the echo return loss and the same feature calculated from a frame of the outgoing speech signal.

24. A method as in claim 21 wherein the feature calculated is the average power of each frame of a signal.

* * * * *